US005975602A

United States Patent [19]

Zan

[11] Patent Number: 5,975,602

[45] Date of Patent: Nov. 2, 1999

[54] CONTOURED SNOW SHOVEL CONSTRUCTION

[76] Inventor: Spencer Zan, 1801 Butler Pike, #283, Conshohocken, Pa. 19428

[21] Appl. No.: 09/038,611

[22] Filed: Mar. 11, 1998

[51] Int. Cl.[6] ..... E01H 5/02

[52] U.S. Cl. ..... 294/54.5; 37/284; 294/58

[58] Field of Search ..... 294/51, 53.5, 54.5, 294/55, 57, 58, 59; 16/114 R, 111 R, 116 R; 37/241, 265, 266, 268, 270, 278, 279, 284, 285; D8/10

[56] References Cited

U.S. PATENT DOCUMENTS

| | | | |
|---|---|---|---|
| 815,122 | 3/1906 | Schaffert | 294/54.5 X |
| 841,848 | 1/1907 | Conner . | |
| 1,232,763 | 7/1917 | Brownstein | 37/266 X |
| 1,534,179 | 4/1925 | Klinger | 37/284 |
| 1,693,472 | 11/1928 | Batty | 294/54.5 X |
| 1,743,161 | 1/1930 | Prindle | 294/54.5 X |
| 2,165,314 | 7/1939 | Stevenson . | |
| 2,785,483 | 3/1957 | Gajewski | 37/284 |
| 4,199,181 | 4/1980 | Mason | 294/54.5 X |
| 4,538,847 | 9/1985 | Lapshansky | 294/51 |
| 4,559,726 | 12/1985 | Moisan | 37/267 |
| 4,958,407 | 9/1990 | Johnson | 294/58 X |
| 5,133,101 | 7/1992 | Hauser et al. | 294/58 X |
| 5,209,534 | 5/1993 | Crenshaw et al. | 294/57 X |

FOREIGN PATENT DOCUMENTS

| | | | |
|---|---|---|---|
| 1387561 | 3/1975 | United Kingdom | 37/284 |
| 2732 | 1/1995 | WIPO | 37/265 |

*Primary Examiner*—Johnny D. Cherry
*Attorney, Agent, or Firm*—Henderson & Sturm

[57] ABSTRACT

A snow shovel construction 10 including a curved and tapered blade member 20 having an enlarged end 21 and a smaller end 22. The blade member 20 is disposed at an angle of approximately 60° relative to a handle member 30 that is provided with a pair of offset hand grip elements 33, 34 and further provided with a reinforcement unit 13 disposed both on the blade member 20 and between the blade member 20 and the handle member 30.

5 Claims, 2 Drawing Sheets

CONTOURED SNOW SHOVEL CONSTRUCTION

BACKGROUND OF THE INVENTION

1. Field of the Invention

The present invention relates to the field of snow shovel constructions in general, and in particular to scoop style snow shovel constructions.

2. Description of Related Art

As can be seen by reference to the following U.S. Pat. Nos. 841,848; 2,165,314; 4,538,847; and 4,559,726, the prior art is replete with contoured scoop style snow shovel constructions.

While all of the aforementioned prior art constructions are more than adequate for the basic purpose and function for which they have been specifically designed, they do not represent the final word in snow shovel constructions of their type.

To begin with, the primary objective of a contoured scoop style snow shovel is to move snow in a lateral fashion across the face of the scooped blade in the most efficient and practical matter possible, while also reducing the amount of effort expended during that task in an ergonomically efficient fashion.

As a consequence of the foregoing situation, there has existed a longstanding need among homeowners and the like, for a new and improved contoured snow shovel construction that employs a reinforced tapered scoop style blade having a unique braced dual handle arrangement that maximizes the work produced per unit of energy expended and the provision of such a construction is a stated objective of the present invention.

BRIEF SUMMARY OF THE INVENTION

Briefly stated, the snow shovel construction that forms the basis of the present invention comprises in general a blade unit, a handle unit connected to the blade unit, and a reinforcement unit associated with both the blade unit and the handle unit.

As will be explained in greater detail further on in the specification, the blade unit comprises a curved and tapered blade member having a large end, a small end and a running length wherein the relative dimensions of the height of the ends and the length of the blade are chosen to produce a blade member that forces snow from the large end to the small end in a lateral fashion that does not require any lifting of the snow shovel construction on the part of the user to remove snow from a surface.

In addition, the reinforcement unit is specifically designed to reinforce the ends and the spine of the blade member while also providing angled brace supports between the blade member and the handle unit.

Furthermore, the handle unit includes a handle member having a pair of vertically staggered and offset handgrip elements that provide an ergonomically efficient means of propelling the snow shovel construction in the forward direction.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
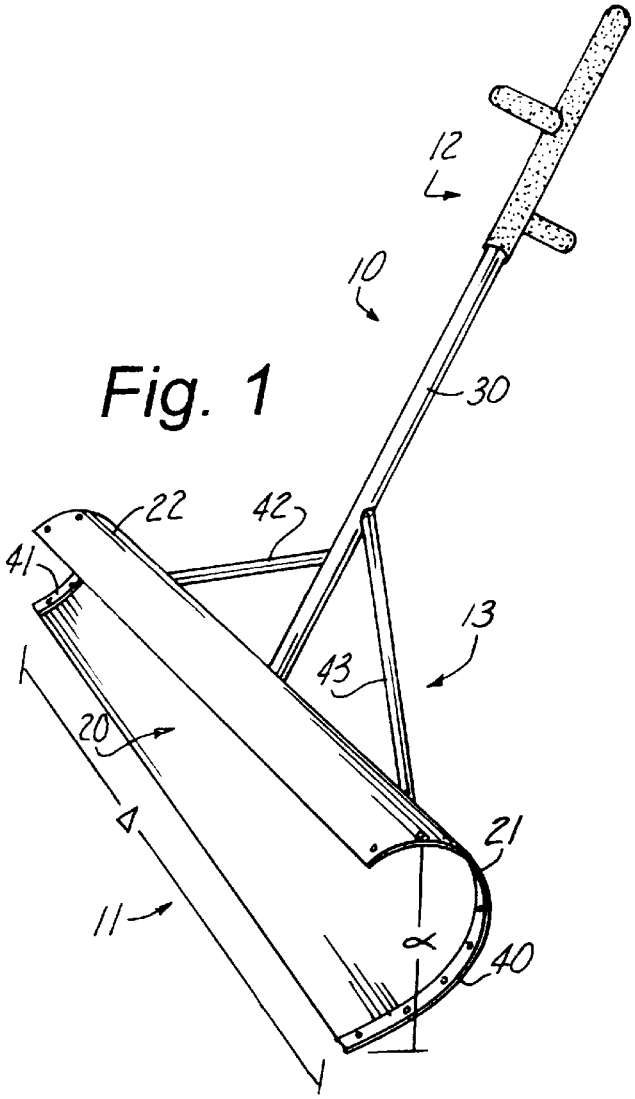
FIG. 1 is a front perspective view of the contoured snow shovel construction that forms the basis of the present invention.
Figure 3:
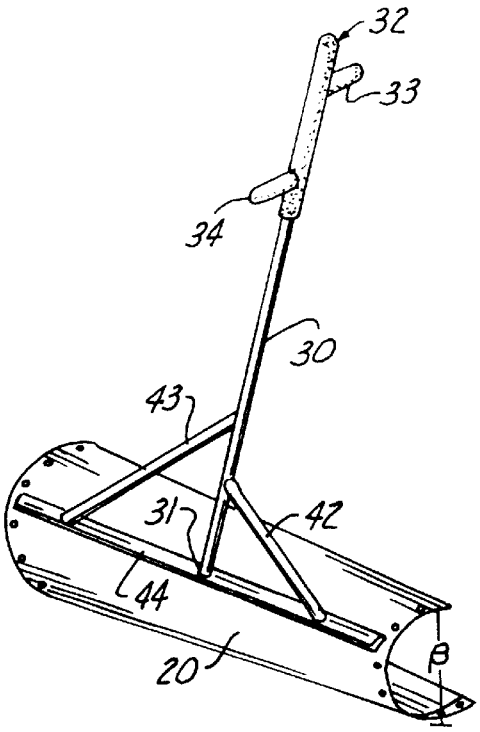
FIG. 3 is a rear perspective view of the snow shovel construction.

As can be seen by reference to the drawings, and in particular to FIG. 1, the contoured snow shovel that forms the basis of the present invention is designated generally by the reference number 10. The shovel construction 10 comprises in general a blade unit 11, a handle unit 12, and a blade reinforcement unit 13. These units will now be described in seriatim fashion.

As shown in FIGS. 1 through 4, the blade unit 11 comprises a generally C-shaped curved and tapered blade member 20 having an enlarged arcuate end 21 and a substantially smaller arcuate end 22. The height "$\alpha$" of the enlarged end 21 is approximately twice the height "$\beta$" of the smaller end.

In addition, the blade member 20 has a running length "$\Delta$" wherein the value of "$\Delta$" is slightly less than twice the value of "$\alpha$" and approximately three times the value of "$\beta$". In the preferred embodiment of the invention illustrated in the drawings, the length "$\Delta$" of the blade member is twenty inches (20"), the height "$\beta$" of the larger end 21 of the blade member 20 is twelve inches (12") and the height "$\alpha$" of the smaller end 22 of the blade member 20 is seven inches (7").

It is believed that the foregoing approximate ratio of heights and lengths will produce the most ergonomically efficient blade member configuration in that the user will expend only minimum energy to move a maximum load of snow in a lateral direction without the necessity of lifting the blade member 20 out of contact with a snow bearing surface.

As shown in FIGS. 1 through 3, 5, and 6, the handle unit 11 comprises an elongated generally tubular handle member 30 secured on the lower end 31 to the blade member 20 and provided on the upper end 32 with a pair of hand grip elements 33 and 34. The upper end 32 and the hand grip elements 33, 34 are provided with a foam rubber coating 35 to both improve the user's frictional grasp on the handle member 30 and to insulate the user's hands from contact with the underlying handle member material.

In addition, the pair of hand grip elements 33 and 34 in the preferred embodiment are positioned on opposite sides of the handle member 30 and vertically spaced relative to one another and the handle member 30 to provide the user with a staggered two handed grip on the handle member 30 to propel the blade member 20 parallel to the axis of the handle member 30.

Figure 2:
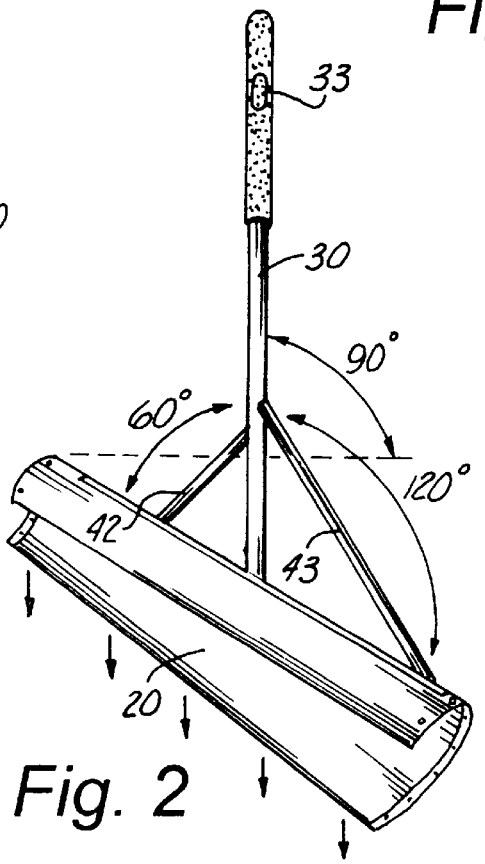
FIG. 2 is a top plan view of the snow shovel construction.
Figure 4:
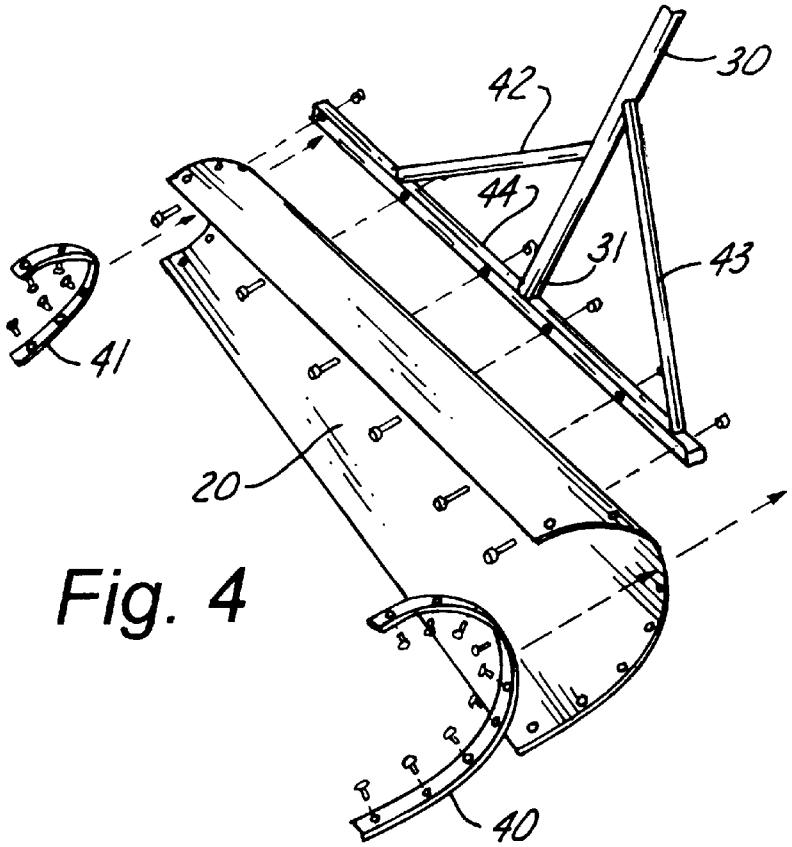
FIG. 4 is an exploded perspective view of the lower portion of the shovel construction.
Figure 5:
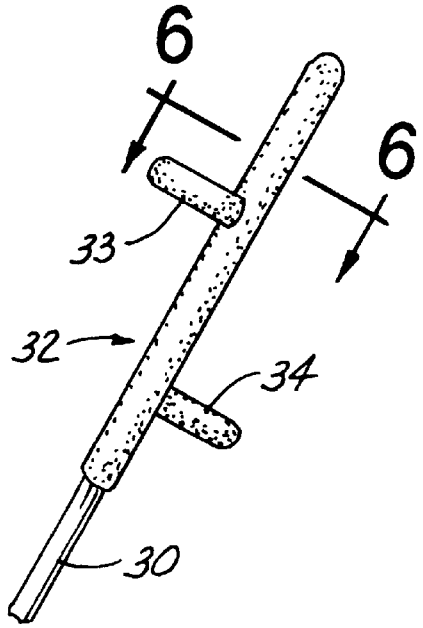
FIG. 5 is an isolated detail view of the snow shovel handle.
Figure 6:
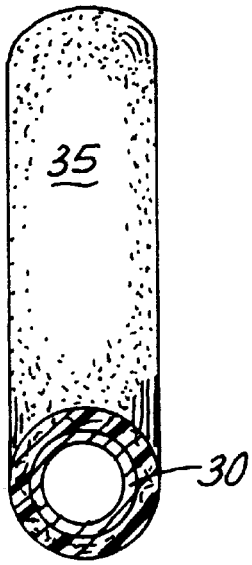
FIG. 6 is a cross-sectional view taken through line 6—6 of FIG. 5.

As can best be seen by reference to FIGS. 2 and 4, the handle member 30 is attached to and intersects the rear surface of the blade member 20 at an angle of 60°. In addition, the blade reinforcement unit 13 comprises a pair of blade end reinforcement strips 40, 41, a pair of angled brace supports 42, 43, and blade spine reinforcement bar 44. The blade end reinforcement strips 40, 41 are disposed on the larger 21 and small 22 ends of the blade member 20 to both provide rigidity to the curved blade member configuration and to provide a reinforced striking surface to dislodge accumulated snow and ice from within the confines of the curved blade member 20.

In addition, the angled brace supports 42, 43, include a relatively short angled brace support 42 disposed at an angle of approximately 60° with respect to the blade reinforcement bar 44 and an elongated angled brace support 43 disposed at an angle of approximately 120° with respect to the blade reinforcement bar 44. The short angled brace support 42 is connected to the blade reinforcement bar 44 midway between the smaller end 22 of the blade member 20 and the juncture of the handle member 30 with the blade reinforcement bar 44. The longer angled brace support is connected to the blade reinforcement bar 44 proximately to but spaced from, the larger end 21 of the blade member 20.

It should be noted that the relative length and placement of the angled brace supports 42, 43 are chosen for a particular purpose and function in that the shovel construction of this invention is designed and intended to collect snow with the leading edge of the larger end 21 of the blade member 20 introducing snow into the curvature of the blade member 20 and laterally transferring the accumulated snow towards the smaller end 22 of the blade member 20. As a consequence of this snow moving feature, the smaller end 22 of the blade member 20 will always have the greatest accumulation of snow, and as a result thereof will require a more rigid bracing arrangement on that end of the shovel construction.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

I claim:

1. A snow shovel construction consisting of:

a curved and tapered blade member having a front surface, a rear surface, an upper end, a lower end, an enlarged arcuate end having a height " " a smaller arcuate end having a height "β" and a spine formed along a longitudinal axis of the blade member which has a running length "Δ";

a handle member operatively connected to the rear surface of the blade member and disposed at an angle of approximately 60° with respect to the longitudinal axis of the blade member; wherein the handle member has an upper end which is provided with a pair of hand grip elements disposed on opposite sides of the handle member; wherein, the hand grip elements are vertically spaced from one another and disposed perpendicular to the handle member; and;

a reinforcement unit including: a pair of reinforcement strips disposed on the arcuate ends of the blade member; a blade reinforcement bar running along the spine of the blade member and;

a pair of angled brace supports operatively connected between the blade reinforcement bar and opposite sides of the handle member wherein the pair of angled brace supports comprises a relatively short brace support disposed on one side of the blade member and a relatively elongated brace support disposed on the other side of the blade member; the relatively short brace support is connected to the blade reinforcement bar approximately midway between the smaller end of the blade member and the juncture of the handle member and the blade reinforcement bar; and the elongated brace support is connected to the blade reinforcement bar proximate to but spaced from the larger end of the blade member.

2. The snow shovel construction as in claim 1 wherein the value of "α" is approximately equal to twice the value of "β".

3. The snow shovel construction as in claim 2 wherein the value of "Δ" is slightly less than twice the value of "α".

4. The snow shovel construction as in claim 3 wherein the value of "Δ" is approximately three times the value of "β".

5. The snow shovel construction as in claim 2 wherein the value of "Δ" is approximately three times the value of "β".

* * * * *